US007937843B2

(12) United States Patent
Partes

(10) Patent No.: US 7,937,843 B2
(45) Date of Patent: May 10, 2011

(54) COMPASS HAVING A LEG JOINT AND INFORMATION BEARING SURFACES

(75) Inventor: Günther Partes, Emskirchen (DE)

(73) Assignee: Intertech Zeichengeraete GmbH, Emskirchen (DE)

( * ) Notice: Subject to any disclaimer, the term of this patent is extended or adjusted under 35 U.S.C. 154(b) by 0 days.

(21) Appl. No.: 12/795,099

(22) Filed: Jun. 7, 2010

(65) Prior Publication Data

US 2011/0000094 A1 Jan. 6, 2011

Related U.S. Application Data

(63) Continuation-in-part of application No. 12/102,339, filed on Apr. 14, 2008, now abandoned.

(30) Foreign Application Priority Data

Apr. 12, 2007 (DE) ..... 10 2007 017 558

(51) Int. Cl.
*B43L 9/02* (2006.01)

(52) U.S. Cl. ..... 33/27.02; 40/358

(58) Field of Classification Search ..... 33/27.02, 33/27.031–27.033; 40/358
See application file for complete search history.

(56) References Cited

U.S. PATENT DOCUMENTS

| | | | | |
|---|---|---|---|---|
| 459,519 | A | 9/1891 | Collins | |
| 1,248,406 | A | 11/1917 | Ryan et al. | |
| 1,575,419 | A | 3/1926 | Doyle | |
| 77,223 | A | 12/1928 | Ern | |
| 2,045,298 | A * | 6/1936 | Hanle | 33/27.02 |
| 2,176,698 | A | 10/1939 | Albrecht | |
| 2,382,341 | A | 8/1945 | Snell | |
| 3,733,708 | A | 5/1973 | Goodman | |
| 4,866,852 | A | 9/1989 | Plier | |

(Continued)

FOREIGN PATENT DOCUMENTS

| | | |
|---|---|---|
| CH | 97888 | 4/1923 |

(Continued)

OTHER PUBLICATIONS

German Patent and Trademark Office Search Report, dated Jul. 6, 2007.

(Continued)

*Primary Examiner* — G. Bradley Bennett
*Assistant Examiner* — Tania C Courson
(74) *Attorney, Agent, or Firm* — Laurence A. Greenberg; Werner H. Stemer; Ralph E. Locher

(57) ABSTRACT

A compass includes two legs having upper ends interconnected in a leg joint and lower ends with holders for refills or styluses. An adjusting spindle penetrates the legs, in particular, in vicinity of the leg joint. The legs have carrier zones in the form of widenings serving in a region between the leg joint and the free leg ends as a base of an information bearing surface surpassing the width of the legs in their spreading plane. The information bearing surfaces are disposed on both broad sides of the compass and constructed as undivided surfaces projecting from one leg into the region of the other leg. If the compass is closed, two mounting disks of the information bearing surfaces lie congruently above one another and only two outer information bearing surfaces and can be seen. All four information bearing surfaces can be seen in the open state of the compass.

16 Claims, 6 Drawing Sheets

U.S. PATENT DOCUMENTS

| | | | | |
|---|---|---|---|---|
| 4,879,812 | A | 11/1989 | Rabb | |
| 4,905,830 | A | 3/1990 | Lin | |
| 5,517,761 | A | 5/1996 | Wang | |
| 5,769,859 | A | 6/1998 | Dorsey | |
| 6,041,530 | A | 3/2000 | Matthews et al. | |
| 6,263,599 | B1 | 7/2001 | Matthews et al. | |
| 6,964,103 | B2 * | 11/2005 | Chudek et al. | 33/27.02 |

FOREIGN PATENT DOCUMENTS

| | | | |
|---|---|---|---|
| DE | 883 205 | | 7/1953 |
| DE | 35 02 556 | A1 | 9/1985 |
| DE | 89 09 747 | U1 | 10/1989 |
| DE | 102 22 635 | A1 | 12/2003 |
| DE | 20 2005 006 673 | U1 | 6/2005 |
| DE | 20 2005 013 280 | U1 | 12/2005 |
| GB | 2 155 407 | A | 9/1985 |

OTHER PUBLICATIONS

Derwent Abstract 2003-104614, Abstract of DE 202 13 964 U1 published on Nov. 28, 2002, "Drawing compass has fittings on shanks for applying decorative strips".

* cited by examiner

COMPASS HAVING A LEG JOINT AND INFORMATION BEARING SURFACES

CROSS-REFERENCE TO RELATED APPLICATION

This is a Continuation-In-Part of application Ser. No. 12/102,339, filed Apr. 14, 2008; this application also claims the priority, under 35 U.S.C. §119, of German Patent Application 10 2007 017 558.4, filed Apr. 12, 2007; the prior applications are herewith incorporated by reference in their entirety.

BACKGROUND OF THE INVENTION

Field of the Invention

The invention relates to a compass having two compass legs provided at their lower ends with holders for refills or styluses and a leg joint for connecting the two compass legs to one another at their upper ends in a jointed fashion, preferably with the aid of an adjusting spindle provided in the vicinity of the leg joint and penetrating the compass legs. The legs are respectively provided with a carrier zone in the form of a widening that serves in the region between the leg joint and the free leg ends as a base of an information bearing surface stretching over and surpassing the width of the compass legs in their spreading plane.

Such a compass is known from German Utility Model DE 20 2005 013 280. In that case, a gap between the two compass legs divides the information bearing surface into two halves that form a practically closed surface only when the limbs lie against one another.

BRIEF SUMMARY OF THE INVENTION

It is accordingly an object of the invention to provide a compass having a leg joint and information bearing surfaces, which overcomes the herein aforementioned disadvantages of the heretofore-known devices of this general type in such a way that an information bearing surface remains an undivided surface without regard to whether or not the compass has its legs spread open.

With the foregoing and other objects in view there is provided, in accordance with the invention, a compass, comprising two broad sides, two legs having upper ends and free lower ends, holders disposed at the free lower ends of the legs for holding refills or styluses and a leg joint interconnecting the upper ends of the legs for articulation in a spreading plane. The legs each have a respective carrier zone serving, in a region between the leg joint and the free lower ends of the legs, as a disk-shaped base of an information bearing surface with outer and inner sides and a greater width in the spreading plane than the legs. The information bearing surface is disposed within the two broad sides on the respective disk-shaped base and constructed as an undivided surface projecting from one of the legs into vicinity of the other of the legs and permitting opening and closing of the legs without a gap or interspace being formed in the information bearing surface. The disk-shaped bases with the information bearing surfaces of the two legs match each other in a congruent double configuration with a small gap therebetween, in a closed position of the legs, thereby displaying the outer sides of the disk-shaped bases together with the information bearing surfaces thereon. The disk-shaped bases, in a wide opened position of the legs, display the outer and inner sides of the disk-shaped bases and four resulting information bearing surfaces thereon.

Advantageous developments of the invention are described below. The advantages that can be attained with the aid of the invention are primarily that the information bearing surface is a closed surface and also thus remains whether or not the compass legs are spread open. Depending on the selected display on the information bearing surface, for example advertising, small works of art, decorative elements or mathematical formulas, a gap can no longer disturb the latter.

Other features which are considered as characteristic for the invention are set forth in the appended claims.

Although the invention is illustrated and described herein as embodied in a compass having a leg joint and information bearing surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
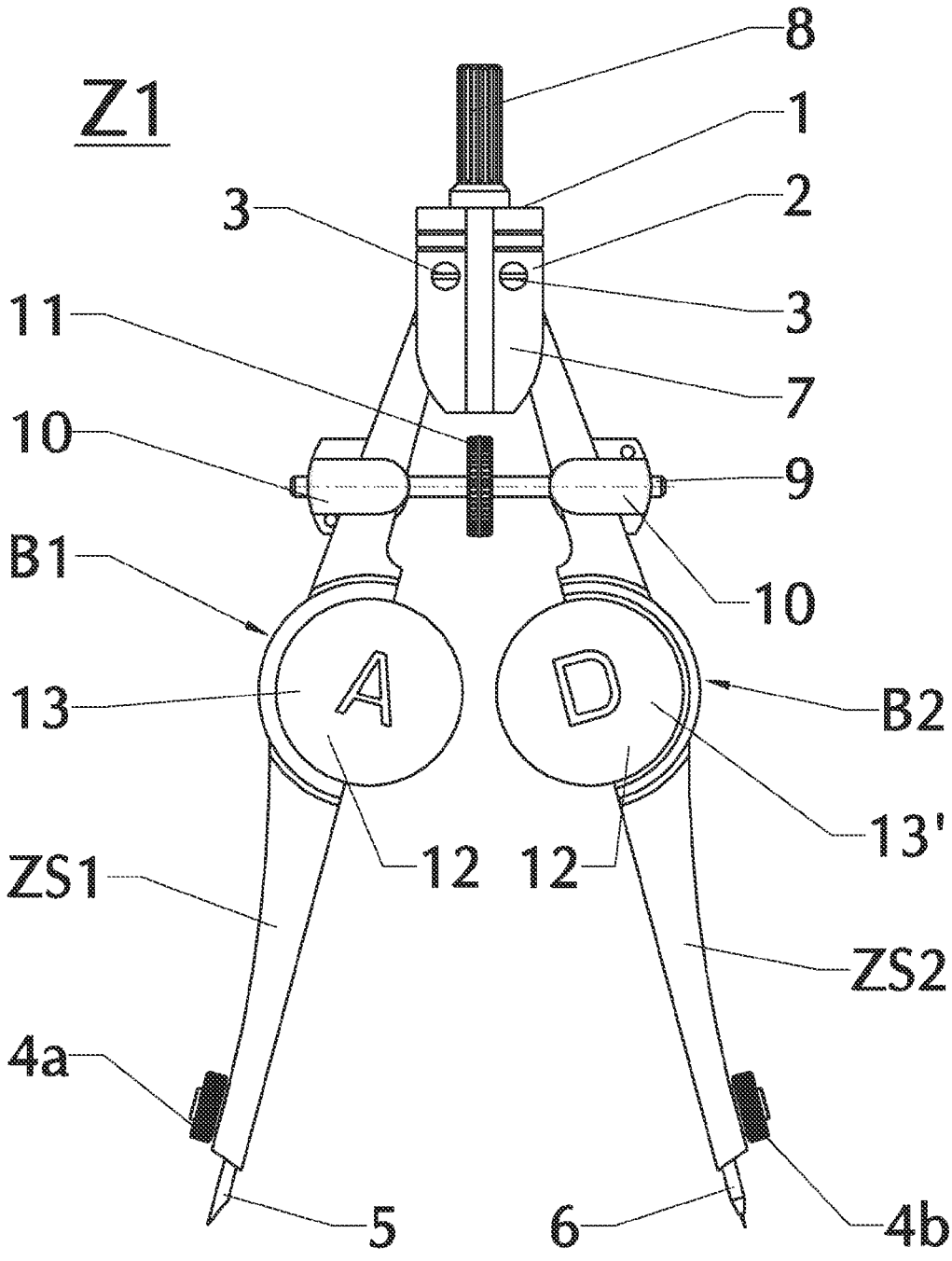
FIG. 1 is a diagrammatic, front-elevational view of a drawing compass according to the invention, with compass legs spread open and having in each case one circular disk-shaped information bearing surface being visible per leg.

Referring now to the figures of the drawings in detail and first, particularly, to FIG. 1 thereof, there is seen a compass Z1 including a head 1 and a leg joint 2 below the head 1 having two joint or head screws 3. The latter are used to connect two compass legs ZS1, ZS2 at their upper ends in a jointed fashion. The legs ZS1, ZS2 are provided at their lower ends with respective holders 4*a*, 4*b* for a refill 5 or a stylus 6. A joint plate 7 and a similar non-illustrated joint plate opposite it are permanently connected to the head 1 and a knurled cylinder 8 adjoining the latter. The compass Z1 is preferably provided with an adjusting spindle 9 provided in the vicinity of the leg joint 2 and penetrating the compass legs ZS1, ZS2. The spindle is rotatably supported on spindle bearings 10 fastened on the legs ZS1, ZS2. A knurled wheel 11, which is seated on the spindle 9 in the middle between the compass legs, enables the compass legs ZS1, ZS2 to be spread open or placed together by rotating the knurled wheel 11 in one direction of rotation or the other.

The legs ZS1, ZS2 are respectively provided with a carrier zone B1, B2 in the form of a widening or a broad side that serves in a region between the leg joint 2 (preferably between the adjusting spindle 9) and free ends of the legs as a base of an information bearing surface 12 stretching over and surpassing a width of the compass legs in their spreading plane. The two information bearing surfaces 12, which are denoted individually by reference symbols A and D on the two legs ZS1, ZS2, can be seen on the front of the compass illustrated in FIG. 1. The information bearing surfaces (abbreviated as IT surfaces in the following text) can have a non-illustrated informative and/or decorative display or design.

Figure 3:
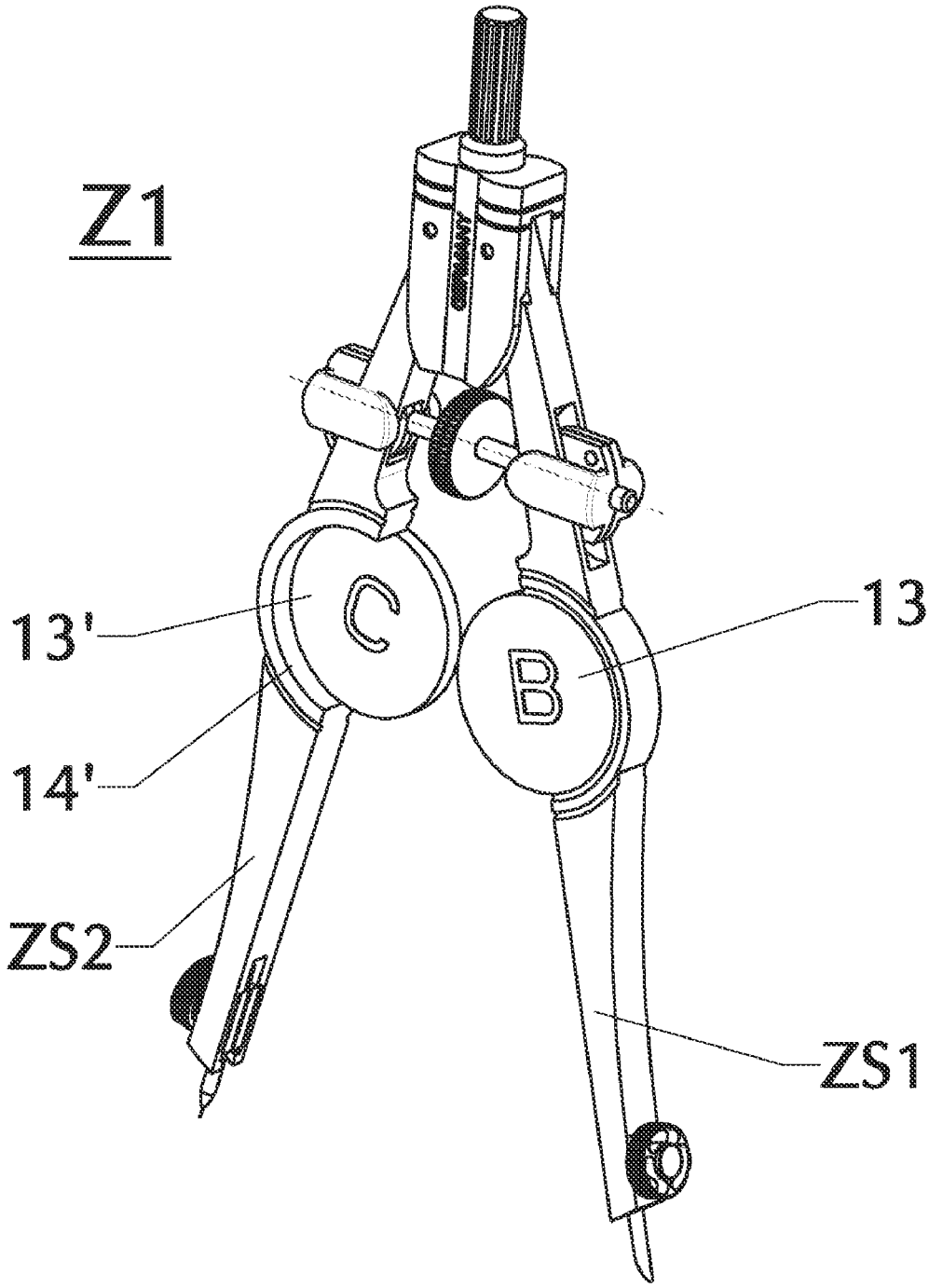
FIG. 3 is a rear-perspective view of the compass according to FIGS. 1 and 2, with two further information bearing surfaces being visible.

According to the invention, the IT surface 12 is provided on both broad sides B1, B2 of the compass Z1 and is constructed as an undivided surface that projects from one leg ZS2, ZS1 into the region of the other leg ZS1, ZS2 and permits the legs to be opened and closed without a gap or interspace being formed in the respective IT surface 12, A, D (or on a rear IT surface B, C of the compass seen in FIG. 3).

In this case, if the compass legs ZS1, ZS2 are closed, the two bases B1, B2 of the IT surfaces 12 overlie one another or are congruent. In this state, the two outer IT surfaces (D, B) are visible. In contrast, in the case of an increased opening width of the compass legs, the visibility of all four IT surfaces A, B, C, D of the compass legs ZS1, ZS2 can be produced.

As is illustrated, the IT surfaces 12 can, in particular, have a circular shape. However, they can also be a non-illustrated regular polygon, for example a quadrangle or hexagon, or have the shape of an ellipse.

The IT surfaces 12 are attached in each case to a circular disk-shaped mounting disk 13, 13' (see FIGS. 1 to 3) which, for its part, is formed integrally with the legs ZS1, ZS2, that is to say is cast integrally onto or is formed in one piece with the latter. In this case, the mounting disk is composed, in particular, of zinc die casting. However, it is also possible for mounting disks 12 to be produced as separate components and then be fastened to semicircular inner surfaces (mounting surfaces 14, 14'), in the region of the widened portions of the legs B1, B2, as is seen in FIGS. 2 and 3.

Figure 2:
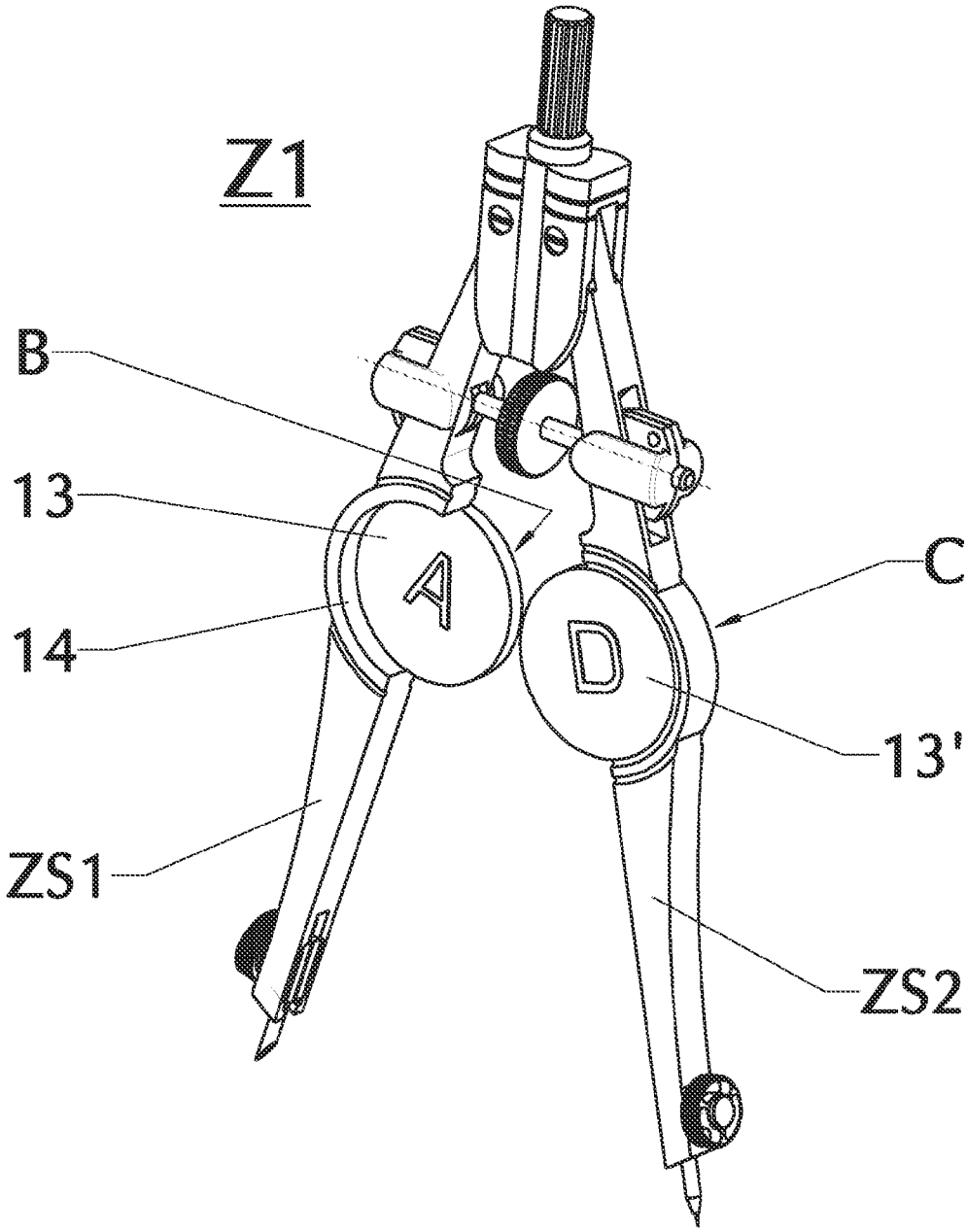
FIG. 2 is a front-perspective view of the compass shown in FIG. 1.
Figure 4:
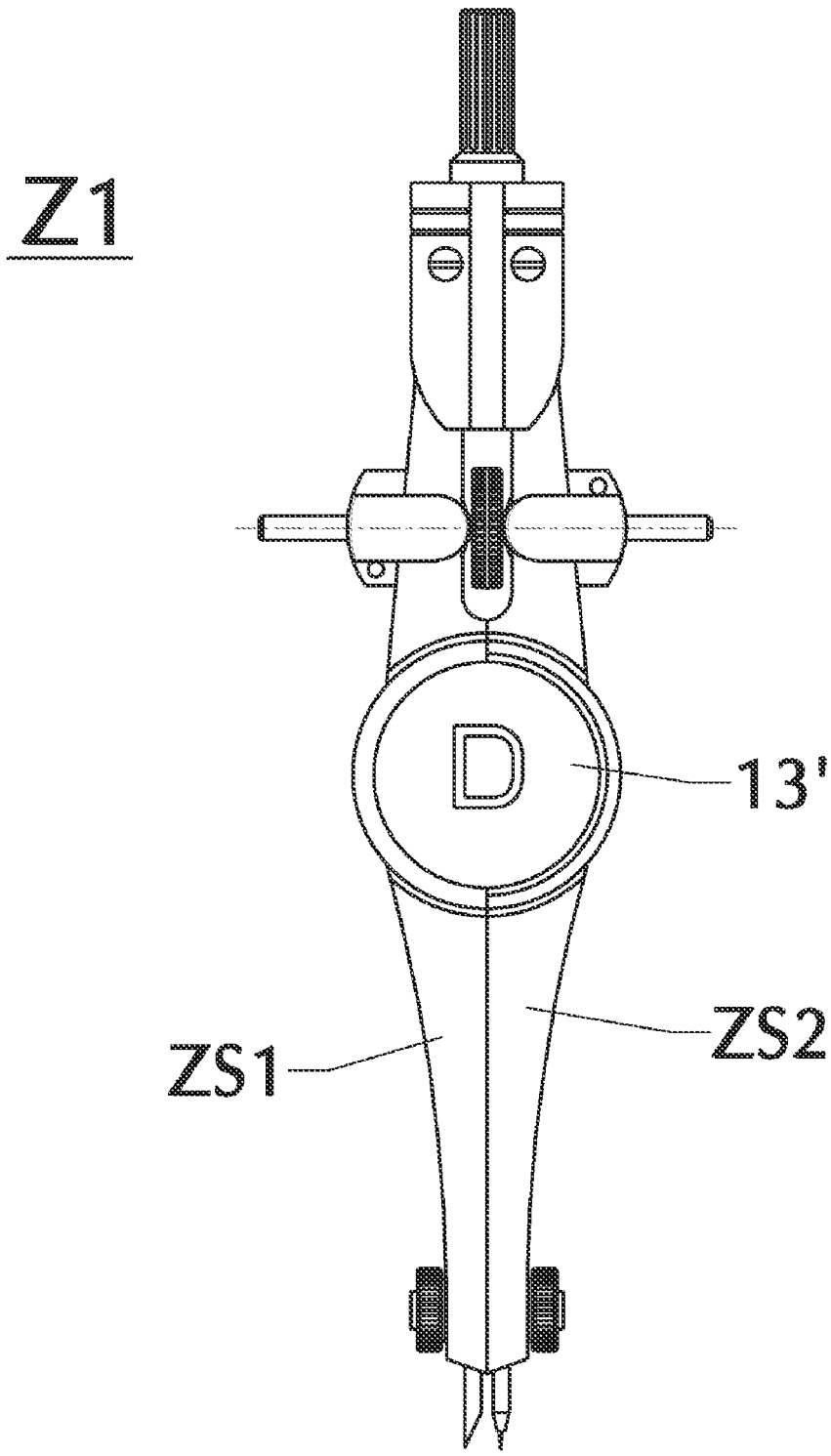
FIG. 4 is a front-elevational view of the compass according to FIGS. 1-3 in a folded-together state, as a result of which front and rear information bearing surfaces are visible and they and their mounting disks are positioned in a congruent double configuration.
Figure 5:
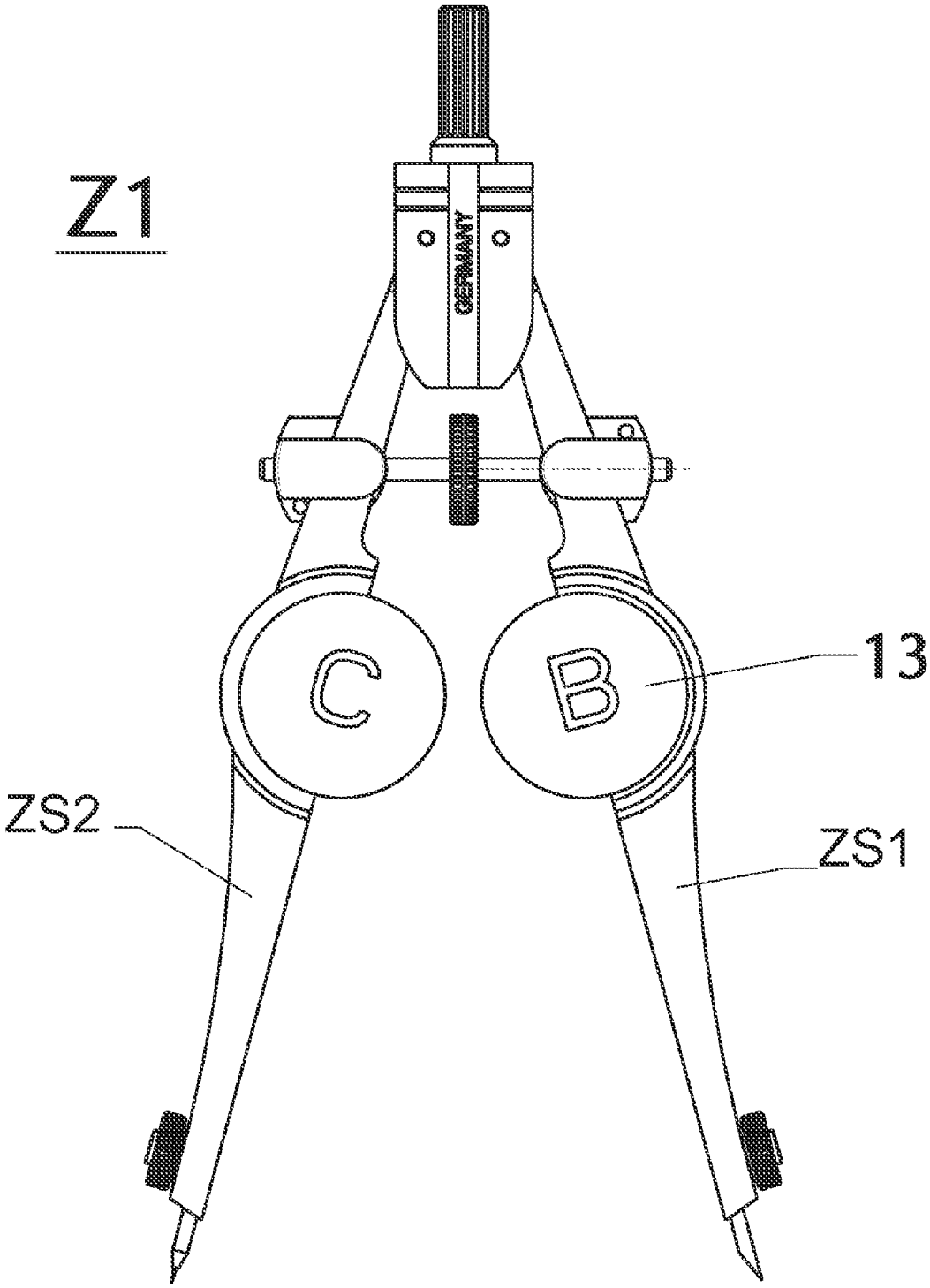
FIG. 5 is a rear-elevational view of the compass according to FIGS. 1 to 4, likewise in a congruent double configuration of the information bearing surfaces and their mounting disks.
Figure 6:
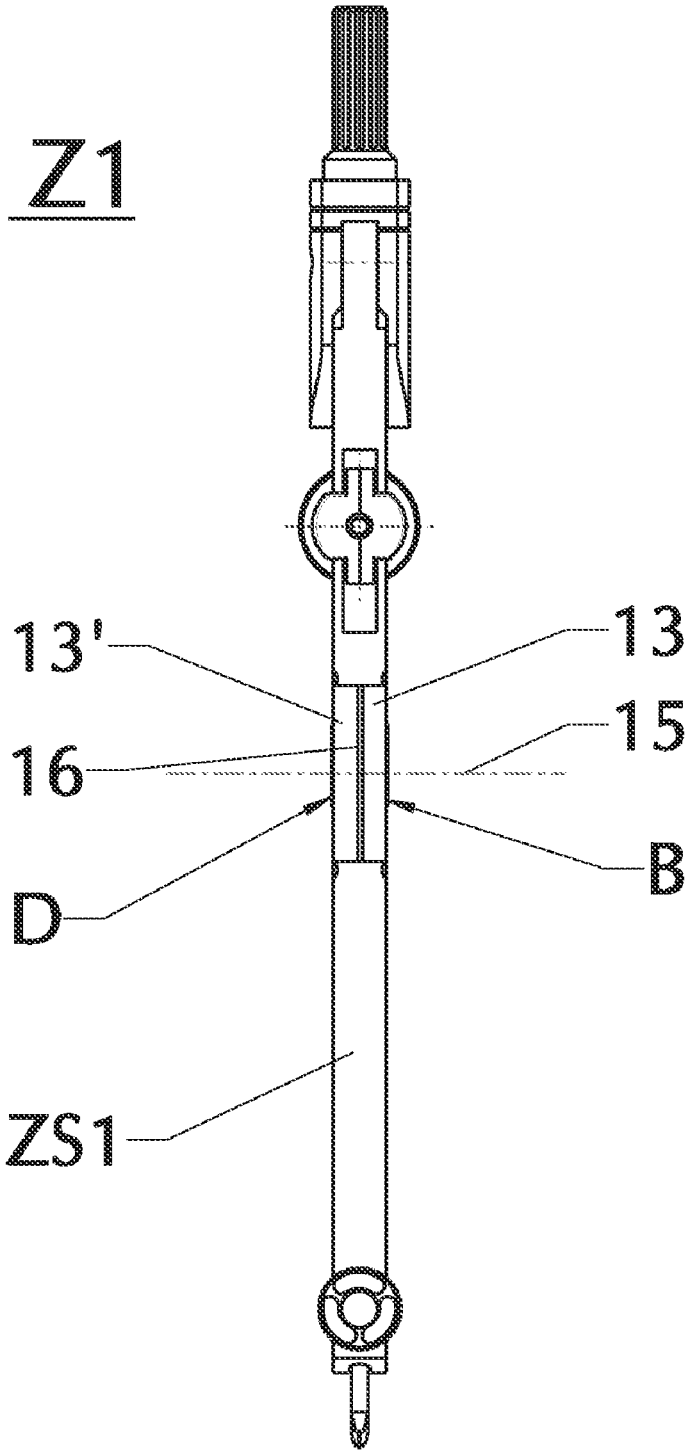
FIG. 6 is a side-elevational view of the subject matter of FIGS. 1-5 in a closed position of the compass legs.

FIG. 6 shows that, in the case of closed compass legs ZS1, ZS2, the two mounting disks 13, 13' are positioned centrically with respect to a virtual axis 15 and with a gap or joint 16, in such a way that, according to FIG. 2 and FIG. 4, when the compass Z1 is closed, the mounting disk 13' comes to lie congruently above the mounting disk 13. If the rear of the compass according to FIGS. 3 and 5 is considered, it can be seen that, when the compass is closed, the mounting disk 13 comes to lie congruently above the mounting disk 13'. In other words: the mounting disks 13, 13' are offset with respect to one another by a mounting disk thickness and by the width of the gap 16 (see FIG. 6). This offset can also be seen from FIGS. 2 and 3. The opening and closing of the compass legs ZS1, ZS2 are therefore not impeded. In the closed state, only the IT surfaces D and B can be seen, whereas all four surfaces A, B, C and D can be seen in the open state. In the example according to FIGS. 1 and 2, the mounting disk 13' is disposed on the front of one leg ZS2 and the other mounting disk 13 is disposed on the rear of the other leg ZS1. If the rear of the compass is considered (FIG. 3), it is the other way around, that is to say the mounting disk 13 is disposed on the front of the leg ZS1 and the mounting disk 13' is disposed on the rear of the leg ZS2.

The information bearing surfaces are labeled symbolically with letters A, B, C and D. As mentioned, these surfaces can have an informative and/or decorative display or design.

The surfaces 12 can be fastened as printed film on the respective mounting disk, in particular bonded onto the latter. However, it is also advantageous to print the printed image of the IT surfaces 12 directly onto the mounting disk 13, 13'. In accordance with a simpler construction, the mounting disk is formed of plastic. In the case of a separate construction of the mounting disk made from metal, that disk can be formed of aluminum. A more valuable construction is distinguished by forming the mounting disk 13, 13' of imprintable coin metal and providing it with an imprint serving the purpose of information and/or decoration. According to a further embodiment, the mounting disk 13, 13' can be provided with a coat of varnish for the IT surfaces 12.

The compasses illustrated in FIGS. 1 to 6 all have the preferred structure with the adjusting spindle 9. The invention also naturally includes structures without an adjusting spindle.

The invention claimed is:

1. A compass, comprising:

two broad sides;

two legs having upper ends and free lower ends;

holders disposed at said free lower ends of said legs for holding refills or styluses;

a leg joint interconnecting said upper ends of said legs for articulation in a spreading plane;

said legs each having a respective carrier zone serving, in a region between said leg joint and said free lower ends of said legs, as a disk-shaped base of an information bearing surface with outer and inner sides and a greater width in said spreading plane than said legs;

said information bearing surface being disposed within said two broad sides on said respective disk-shaped base and constructed as an undivided surface projecting from one of said legs into vicinity of the other of said legs and permitting opening and closing of said legs without a gap or interspace being formed in said information bearing surface;

said disk-shaped bases with said information bearing surfaces of said two legs matching each other in a congruent double configuration with a small gap therebetween, in a closed position of said legs, thereby displaying said outer sides of said disk-shaped bases together with said information bearing surfaces thereon; and said disk-shaped bases, in a wide opened position of said legs, displaying said outer and inner sides of said disk-shaped bases and four resulting information bearing surfaces thereon.

2. The compass according to claim 1, wherein said information bearing surfaces have a circular shape.

3. The compass according to claim 1, wherein said information bearing surfaces have a shape of a regular polygon, a quadrangle or a hexagon.

4. The compass according to claim 1, wherein said information bearing surfaces have a shape of an ellipse.

5. The compass according to claim 4, wherein said mounting disks are each integral with a respective one of said legs.

6. The compass according to claim 5, wherein said mounting disks are each cast onto a respective one of said legs.

7. The compass according to claim 1, wherein said legs each have a mounting disk, a leg widening and a support surface in vicinity of said leg widening, said information bearing surfaces being attached to said mounting disks and fastened on said support surface.

8. The compass according to claim 7, wherein, in the closed position of said legs, said two mounting disks are positioned with a gap over one another in a congruent double configuration on front and rear sides of said two legs.

9. The compass according to claim 7, wherein one of said mounting disks is disposed on a front side of one of said legs and the other of said mounting disks is disposed on a rear side of the other of said legs.

10. The compass according to claim 7, wherein said information bearing surfaces are each fastened or bonded as a printed film on a respective one of said mounting disks.

11. The compass according to claim 7, wherein printed images of said information bearing surfaces are printed directly onto said mounting disks (13, 13'; 130, 130').

12. The compass according to claim 7, wherein said mounting disks are formed of metal.

13. The compass according to claim 7, wherein said mounting disks are formed of diecast zinc.

14. The compass according to claim 7, wherein said mounting disks are formed of imprintable coinage metal and provided with an imprint for information and/or decoration.

15. The compass according to claim 7, wherein said mounting disks are formed of plastic.

16. The compass according to claim 7, wherein said mounting disks are provided with a coat of varnish for said information bearing surfaces.

* * * * *